US005113046A

United States Patent [19]

Hauk

[11] Patent Number: 5,113,046

[45] Date of Patent: May 12, 1992

[54] HOUSING FOR A MICRO-SWITCH UNIT

[75] Inventor: Klaus Hauk, Altrip, Fed. Rep. of Germany

[73] Assignee: Deere & Company, Moline, Ill.

[21] Appl. No.: 620,820

[22] Filed: Dec. 3, 1990

[30] Foreign Application Priority Data

Jan. 27, 1990 [DE] Fed. Rep. of Germany ..... 4002371

[51] Int. Cl.[5] ..... H01H 3/04

[52] U.S. Cl. ..... 200/332; 200/332.1; 200/302.3

[58] Field of Search ..... 200/332, 332.1, 302.3

[56] References Cited

U.S. PATENT DOCUMENTS

| | | | |
|---|---|---|---|
| 2,431,747 | 12/1947 | Fry | 200/561 X |
| 2,726,105 | 12/1955 | Koenig | 200/302.3 X |
| 2,744,984 | 5/1956 | Hults | 200/302.3 |
| 2,795,959 | 6/1957 | Roeser | 200/302.3 |
| 2,806,114 | 9/1957 | Bastian | 200/302.3 |
| 3,087,341 | 4/1963 | Hults | 200/302.3 X |
| 3,155,807 | 11/1964 | Wiley | 200/332 |
| 3,210,507 | 10/1965 | Kadisevskis et al. | 200/332 |
| 3,375,340 | 3/1968 | Wright | 200/332.1 X |
| 3,898,397 | 8/1975 | Devore et al. | 200/6 A |
| 4,356,368 | 10/1982 | Osika | 200/307 |
| 4,429,200 | 1/1984 | Glenn et al. | 200/332.1 X |
| 4,453,062 | 6/1984 | Brown et al. | 200/314 |

FOREIGN PATENT DOCUMENTS

| | | |
|---|---|---|
| 1199354 | 9/1962 | Fed. Rep. of Germany . |
| 1247438 | 1/1963 | Fed. Rep. of Germany . |
| 1147287 | 4/1963 | Fed. Rep. of Germany . |
| 8815814 | 12/1988 | Fed. Rep. of Germany . |
| 3812652 | 8/1989 | Fed. Rep. of Germany . |
| 1004430 | 2/1964 | United Kingdom . |

OTHER PUBLICATIONS

Honeywell Micro Switch, "Series V5 Minatur-Basisschalter", 1988.

Firmendruckschrift Burgess-Mikroschalter, 2. Auflage, 1977 Seiten 69 und 70.

*Primary Examiner*—Renee S. Luebke

[57] ABSTRACT

A commercially available micro-switch is enclosed in a two-piece plastic housing which is provided with centering pins. A tab and slot connection forms a labyrinth between the two housing halves and helps protect the interior from intrusion by dust and water. A mechanical actuator is preferably a U-shaped configuration of flat spring steel with one leg located inside the housing and with another leg located outside the housing. The inner leg of the actuator is divided into a first curved tongue and a second tongue. The second tongue extends along an interior of a side wall of the housing and has a free end which engages the micro-switch unit. A base which connects the inner and outer legs extends through an aperture in the housing and is supported, free from any wear, by an O-ring seal between both housing halves.

4 Claims, 3 Drawing Sheets 48
46
28
4
4
55
20
52
58
22
50
49
38
36
16
44
42
14
40
14
16
40
42
10
36
44
34
40
3
29
30
18
30
16
3
14
12
16
22
20
32
9

HOUSING FOR A MICRO-SWITCH UNIT

BACKGROUND OF THE INVENTION

This invention relates to a housing and actuator assembly for enclosing and actuating a standard commercially available micro-switch unit.

Micro-switch units are low-cost mass produced articles and are used in a wide variety of applications. These switches are capable of switching high currents up to 25 amperes despite their relatively small size (for instance 30 mm by 20 mm by 10 mm). For reasons of low cost it may be desirable to use such switches in tractor applications. For example, there are possible applications in the operation or control of individual functions such as hand brake, power take-off shaft, door switches, magnetic clutch override control, or brake lights. The aforementioned switches, however, do not have a sealed housing. Therefore, they cannot be used in an dusty or wet environment unless the switches are protected from environmental influences such as dust and water spray. It would be desirable to provide a low cost protective housing for a commercially available compact micro-switch unit, which housing would permit use of the switch in a multiplicity of applications and that protects the switch from environmental influences such as dust and water spray.

SUMMARY OF THE INVENTION

An object of the invention is to provide a low cost housing and actuator assembly to protect a commercially available compact micro-switch unit from the environment.

This and other objects are achieved by the present invention which includes a two-piece plastic housing. The two-part housing encloses and seals and protects the micro-switch unit from the environment. The two-part housing includes centering pins which extend through corresponding mounting holes in the micro-switch unit to position the micro-switch unit therein and openings for electrical lines. The invention also includes a mechanical actuator for actuating the micro-switch. The mechanical actuator is preferably a U-shaped configuration of flat spring steel with one leg located inside the housing and with another leg located outside the housing. The inner leg of the actuator is divided into a first curved tongue and a second tongue. The second tongue extends along an interior of a side wall of the housing and has a free end which engages the micro-switch unit. A base which connects the inner and outer legs extends through an aperture in the housing and is supported, free from any wear, by an O-ring seal between both housing halves.

DETAILED DESCRIPTION

Figure 1:
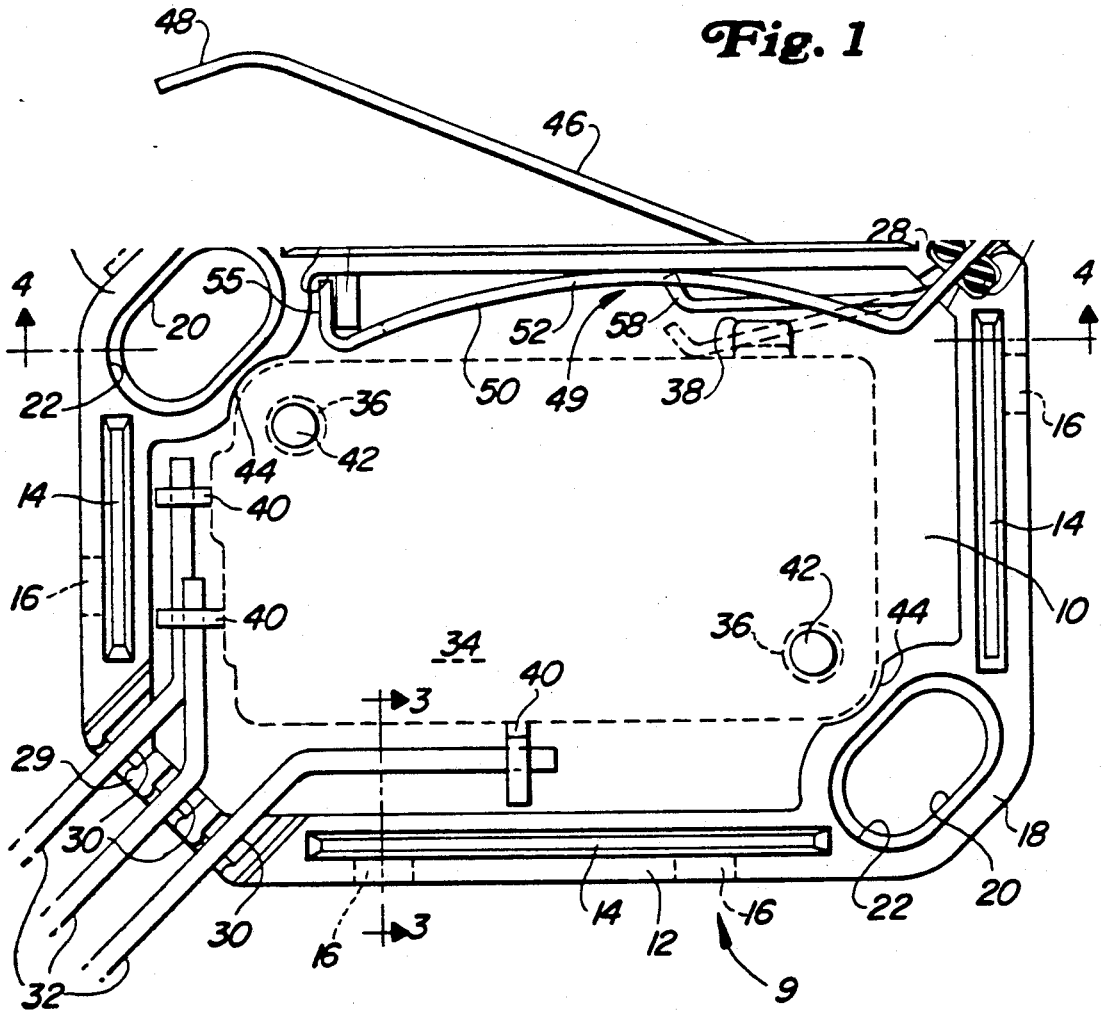
FIG. 1 is a view of the inside of a box-shaped housing half in which the micro-switch unit is inserted.

FIG. 1 shows the interior of a box-shaped housing half 9. The housing half 9 includes a base plate 10 from the periphery of which extend side walls 12. The side walls 12 have straight sections which include outwardly opening longitudinal slots 14. Locking recesses 16 extend from each slot 14 to the outer surface of each side wall 12. The housing may be formed out of plastic such as glass fiber-reinforced polyamide, for example.

In two opposite corners a boss 18 is integrated into the side walls 12, rising above the base plate 10. A through hole 20 extends through the boss 18, and is used to attach the housing to any desired equipment. The through hole 20 is oval-shaped to permit some adjustment during mounting of the housing. The through hole 20 is stepped and has a wider diameter portion 22 at its upper end.

In another corner of the housing half 9 an opening 24 sealingly receives an O-ring 26, which, in turn, sealingly receives an actuating spring member 28. The fourth corner is provided with a ledge 29 rising above the base plate 10, whose upper profile is shaped to provide semicircular recesses 30. The recesses 30 receive, and are shaped to conform to the cross section of, the three electrical lines 32 of the micro-switch unit 34.

The micro-switch unit 34 is shown in dashed lines within the housing half. This is a generally slab-shaped part with rounded corners. Two mounting holes 36 extend through two opposite corners of the micro-switch unit 34. The diameter of mounting holes 36 is preferably less than the diameter of the mounting holes 20 in the housing half. The cross section of these holes is preferably greater than the diameter of the mounting holes of the micro-switch. This permits the use of larger screws than would be possible in mounting the micro-switch directly, and thus permits the use of larger screwdrivers which are normally used, for example, in vehicle assembly, in particular in agricultural tractor assembly. An actuating device 38 projects from one side of the micro-switch unit 34, which can be depressed inward whereby a switching operation is triggered within the micro-switch unit 34. On two other sides of the micro-switch unit 34 electrical terminals 40 protrude to which the electrical lines 32 are connected electrically.

The micro-switch unit 34 is fixed in its position within the box-shaped housing half 9 by means of centering pins 42 which extend from the base plate 10 and into the mounting holes 36 of the micro-switch unit 34, and by means of semicircular pockets 44 in the bosses 18 which engage the rounded corners of the micro-switch unit 34. Since the micro-switch unit 34 is reinforced in the region of its mounting holes 36, and since its positioning is performed in this region of the housing, the micro-switch unit 34 can absorb a part of the forces that are applied externally to the housing. Due to this arrangement the micro-switch unit 34 carries some of the forces and reduces the forces upon the housing, which in turn can be lighter in design.

The actuating member 28 is generally U-shaped and is formed of a flat strip of spring steel with a width corresponding approximately to the height of the side walls 12. The actuating member 28 includes an outer leg 46 connected to an inner leg 49 by a base or central portion 47. The base 47 extends through opening 24 and is sealingly received by the O-ring 26. The inner leg 49 of the spring member 28 is divided into tongues 50 and 58. The outer leg 46 extends from the base 47 to the neighboring corner of the housing, and extends generally along the outer surface of the adjacent side wall 12. In its unloaded condition the outer leg 46 extends at an angle to the adjacent side wall 12. The outer leg 46 can be pushed against the side surface of the housing by a force which may be applied at any point along the outer leg 46 and at any angle within a large range of angles. Thereupon the bent free end 48 of the outer leg 46 is brought into contact with the rounded contour of the housing half 9, as is shown in FIG. 1 in dashed lines.

The tongue 50 extends inside the housing half 9 from the central portion to a free end 55. The free end 55 of the tongue 50 is bent in the direction of the outer leg 46. The free end 55 is held in a slot 54 which is formed between a ridge 56 projecting inward from the side wall 12 and the boss 18. An outer surface of the micro-switch 34 holds the free end 55 in the slot 54. The tongue 50 has a semi-circular curvature or bow 52 and is concave in a direction towards the switch 34. In its unloaded condition the crest of the bow 52 engages the inner surface of the side wall 12.

Figure 4:
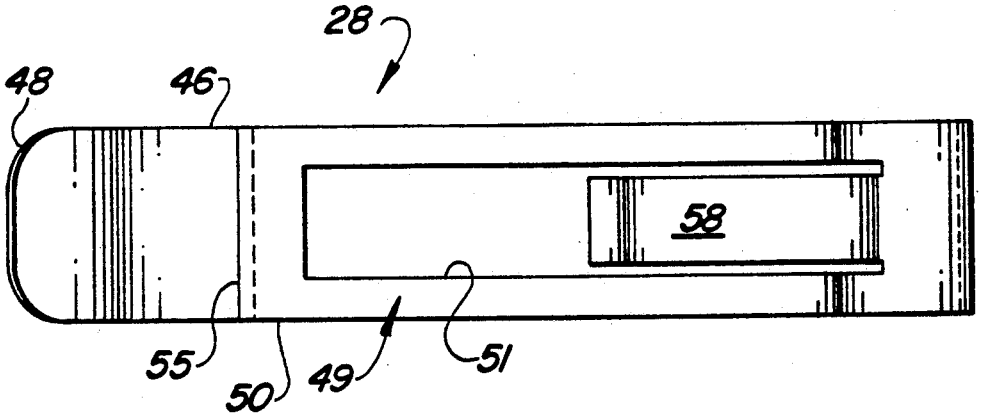
FIG. 4 is a view of the actuating member apart from the housing and viewing in the direction of lines 4–4 of FIG. 1.

As best seen in FIG. 4, a generally rectangular shaped recess or opening 51 is formed in the tongue 50 and extends through the region of the bow 52 from near the penetration 24 to the free end 55. The tongue 58 is partially received by the opening 51. The tongue 58 is located so as to be engageable with the actuating device 38 of the micro-switch unit 34. If the outer leg 46 of the actuating member 28 is pressed against the side wall 12 of the housing half 9, the tongue 50 bends so that the bow 52 tends to flatten and the tongue 58 moves towards the actuating device 38 of the micro-switch unit 34 and presses it into the housing of the micro-switch, triggering an electrical switching operation.

Figure 2:
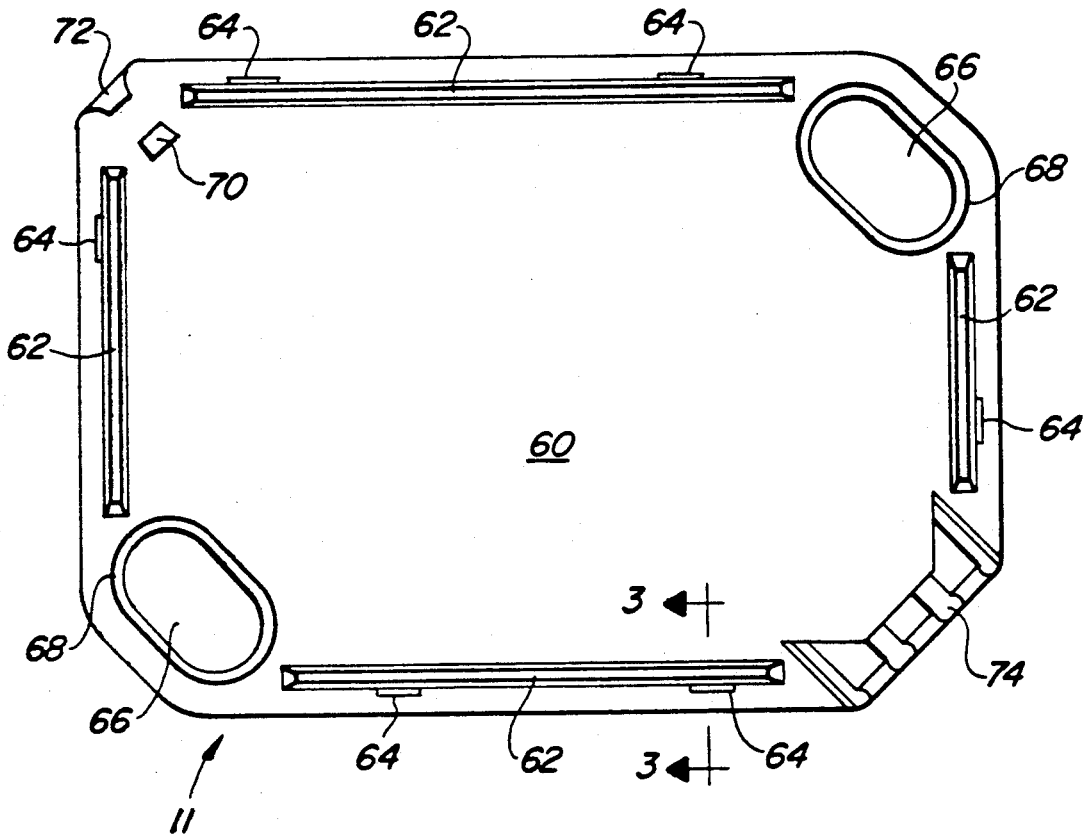
FIG. 2 is a view of the inside of a cover-shaped housing half.

The box-shaped housing half 9 is closed by a second housing half or cover 11 as best seen in FIG. 2. The cover includes a base plate 60. Cover ribs 62 extend perpendicular from the edges of the base plate 60. The cover ribs 62 are positioned and configured so that the ribs 62 can be inserted into the corresponding slots 14 of the housing half 9. The ribs 62 are provided with detent tabs 64 which are received in the locking recesses 16 so that the cover 11 is firmly connected to the housing half 9. Mounting holes 66 are located in two opposite corners of the cover 11. The location and size of the mounting holes 66 corresponds to the mounting holes 20 of the housing half 9. The mounting holes 66 are each surrounded by a raised rim 68 that is received by the larger diameter mounting hole portion 22. This stepped configuration assures a tight seal of the housing halves with each other. By this means the housing is sealed, even in the region of the mounting opening. Attachment of the micro-switch unit to the housing halves by screws or adhesive in the interior of the housing is not necessary, since it is fixed in the housing by the centering means.

Projections 70 and 72 project from another corner of the base plate 60 and engage the O-ring 26 which is seated in the housing half 9. The fourth corner of the cover 11 forms a surface 74 which fits with the upward facing profile of the ledge 29 of housing half 9. Surface 74 and ledge 29 cooperate to form openings which tightly receive the electrical lines 32 of the micro-switch unit 34.

Figure 3:
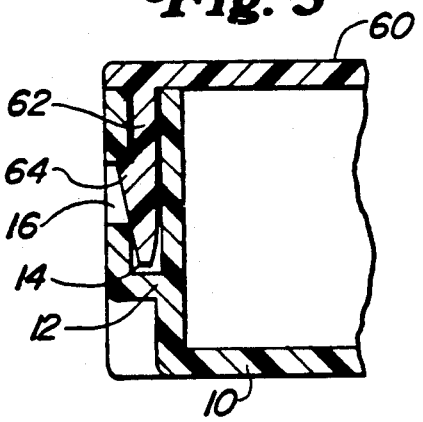
FIG. 3 is a sectional view along the line 3—3 of FIG. 2 showing a portion of the two housing halves engaged with each other.

Referring now to FIG. 3, the recess 16 in the housing side wall 12 of the housing half 9 receives the detent lug 64 projecting from the rib 62 of the cover 11. The assembled housing can be mounted on any desired equipment by means of screws inserted through the mounting holes 20, 66. By means of the screws the housing halves are pressed together, further enhancing the sealing between the two housing halves.

During assembly the micro-switch unit is inserted into one half of the housing and is clamped by closing with the other half of the housing. The housing halves can be manufactured at low cost by molding and can be so designed as to permit a multiplicity of applications of the micro-switch, without requiring additional protection against environmental influences. The encapsulation enlarges the switch unit only slightly. This arrangement assures a well reinforced housing and forms a labyrinth which helps prevent entry of dust and water spray. The availability of a micro-switch so encapsulated eliminates the requirement for using different switches at various locations, since the encapsulated switch unit now provides for the necessary sealing in addition to the small, compact arrangement and high current switching capacity.

While the invention has been described in conjunction with a specific embodiment, it is to be understood that many alternatives, modifications and variations will be apparent to those skilled in the art in light of the foregoing description. Accordingly, this invention is intended to embrace all such alternatives, modifications and variations which fall within the spirit and scope of the appended claims.

I claim:

1. An enclosure for a micro-switch unit, the enclosure comprising a housing for enclosing the micro-switch unit therein and an actuator element extending through an aperture in the housing and operatively engaging the micro-switch unit, the actuator element comprising a generally U-shaped plate spring having an outer leg extending outside the housing, an inner leg extending inside the housing an operatively engaging the micro-switch unit, and a base portion connecting the inner leg to the outer leg, the base portion extending through the aperture, characterized by:

an inner portion of the housing forming a slot which opens towards the interior of the housing; and the inner leg of the actuator element having a free end which is bent towards the housing and is received by the slot.

2. An enclosure for a micro-switch unit comprising a housing for enclosing the micro-switch unit therein and an actuator element extending through an aperture in the housing and operatively engaging the micro-switch unit, the actuator element comprising a generally U-shaped plate spring having an outer leg extending outside the housing, an inner leg extending inside the housing and operatively engaging the micro-switch unit, and a base portion connecting the inner leg to the outer leg, the base portion extending through the aperture, characterized by:

the inner leg is curved and is concave in a direction facing towards the micro-switch unit, a middle portion of the inner leg being engageable with the housing when the actuator element is in unloaded condition.

3. An enclosure for a micro-switch unit, the enclosure comprising a housing for enclosing the micro-switch unit therein and an actuator element extending through an aperture in the housing and operatively engaging the micro-switch unit, the actuator element comprising a generally U-shaped plate spring having an outer leg extending outside the housing, an inner leg extending inside the housing and operatively engaging the micro-switch unit, and a base portion connecting the inner leg to the outer leg, the base portion extending through the aperture, characterized by the inner leg comprising:

a first tongue which extending along the housing; and a second tongue, the first and second tongues being connected to the base portion, and the second tongue having a free end which engages the micro-switch unit.

4. The enclosure of claim 3, wherein: the second tongue is curved and is concave in a direction facing towards the micro-switch unit, a middle portion of the the second tongue being engageable with the side wall when the actuator element is in an unloaded condition.

* * * * *